US006365309B1

(12) United States Patent
Tokutake et al.

(10) Patent No.: US 6,365,309 B1
(45) Date of Patent: Apr. 2, 2002

(54) PHOTOSENSITIVE MEMBER FOR ELECTROPHOTOGRAPHY WITH SPECIC SURFACE PROTECTIVE LAYER

(75) Inventors: Shigeaki Tokutake, Takatsuki; Keiichi Inagaki, Itami; Teiko Edo, Kawanishi; Mitsutoshi Sakamoto, Osaka, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/495,468

(22) Filed: Feb. 1, 2000

(30) Foreign Application Priority Data

Feb. 1, 1999 (JP) ..... 11-023712

(51) Int. Cl.[7] ..... G03G 5/147
(52) U.S. Cl. ..... 430/67; 430/66
(58) Field of Search ..... 430/66, 67

(56) References Cited

U.S. PATENT DOCUMENTS 5,260,157 A 11/1993 Mizuta et al.
5,272,029 A * 12/1993 Sakai et al. ..... 430/67
5,912,098 A 6/1999 Tanaka et al.
5,955,230 A * 9/1999 Kmiura et al. ..... 430/67
5,994,011 A * 11/1999 Kashimura ..... 430/66

FOREIGN PATENT DOCUMENTS

| | | |
|---|---|---|
| JP | 61-51155 | 3/1986 |
| JP | 1-263660 | 10/1989 |
| JP | 3-135577 | 6/1991 |
| JP | 3-141365 | 6/1991 |
| JP | 5-341551 | 12/1993 |
| JP | 8-95280 | 4/1996 |
| JP | 9-319130 | 12/1997 |

OTHER PUBLICATIONS

Grant, Roger et al. Grant & Hackh's Chemical Dictionary. New York: McGraw–Hill, Inc. p. 84. (1987).*

* cited by examiner

*Primary Examiner*—Christopher Rodee
(74) *Attorney, Agent, or Firm*—McDermott, Will & Emery

(57) ABSTRACT

The present invention provided a photosensitive member for electrophotography having excellent durability and adhesion between a surface protective layer and a photosensitive layer. In the photosensitive member for electrophotography wherein at least the photosensitive layer and the surface protective layer are laminated on an electroconductive support in this order, the characteristic is that said surface protective layer comprises at least polysiloxane and silyl group-containing vinyl resin.

17 Claims, No Drawings

PHOTOSENSITIVE MEMBER FOR ELECTROPHOTOGRAPHY WITH SPECIC SURFACE PROTECTIVE LAYER

This application is based on application(s) No. Hei 11-023712 filed in Japan, the contents of which are hereby incorporated by reference.

BACKGROUND OF THE INVENTION

1. Field of the Invention

The present invention relates to an electrophotographic phototeceptor, more particularly, relates to the photosensitive member for electrophotography having an excellent mechanical strength and a high durability which can be adapted for a copying machine for a digital image.

2. Description of the Related Art

In the photosensitive member which has formerly been employed in the field of the electrophotography, it is a general technical matter to form a surface protective layer on a photosensitive layer formed on an electroconductive support in order to prevent an abrasion of the photosensitive layer caused by a cleaning member and the like as well as an injection of charge into the photosensitive layer. It has been known that silica is a preferred compound for the surface protective layer from the viewpoint of a durability, said silica being constituted by three-dimensional network of siloxane bond (Si—O—Si bond). However, in the case of the surface protective layer consisting of only silica, there are problems that cracks occur on the surface of said layer, and an adhesion to the photosensitive layer becomes worse, and an electrostatic property of the photosensitive layer is lowered [see, for example, Japanese Patent Publication (KOKAI) Nos. 51155/1986].

For this reason, the surface protective layers have been proposed which are prepared by coating a solution comprising a mixture of polymers, such as acrylic resin, urethane elastomer, polyamide or the like and an organosilane which is a raw material of silica (solution for protection the surface) on the photosensitive layer and then curing said mixture [see, for example, Japanese Patent Publication (KOKAI) Nos. 141365/1991, 263660/1989, 341551/1993 and 135577/1991, and U.S. Pat. No. 5,260,157]. However, in the cases of these surface protective layers, there are problems that a durability (especially abrasive resistance) because a denseness and a surface hardness of said layers are low as a layer. In addition, these surface protective layers bring about the problem that when a layer thickness becomes thick (about 5 $\mu$m), a sensitivity becomes low, and a residual voltage becomes high, and a fog and the like occur at the time of plate wearing.

SUMMARY OF THE INVENTION

The object of the present invention is to provide a photosensitive member for electrophotography having excellent durability and adhesion between the surface protective layer and the photosensitive layer.

Another object of the present invention is to provide a photosensitive member for electrophotography having excellent electrostatic properties, such as sensitivity, which does not bring about the problems concerning cracks and the like.

The present invention relates to a photosensitive member for electrophotography, comprising:

an electroconductive support, a photosensitive layer, and a surface protective layer comprising polysiloxane and silyl group-containing vinyl resin, and a production method thereof.

DETAILED DESCRIPTION OF THE INVENTION

The present invention relates to a photosensitive member for electrophotography wherein at least the photosensitive layer and the surface protective layer are laminated on the electroconductive support in this order, characterized in that said surface protective layer comprises at least polysiloxane and silyl group-containing vinyl resin.

The surface protective layer according the present invention comprises at least polysiloxane and silyl group-containing vinyl resin. Preferably, the surface protective layer comprises a polymer wherein polysiloxane and silyl group-containing vinyl resin are chemically bonded. In other words, in the surface protective layer, polysiloxane and silyl group-containing vinyl resin exist in a mixed state, and preferably, polysiloxane and silyl group-containing vinyl resin are chemically bonded.

In the surface protective layer of the photosensitive member according to the present invention, polysiloxane has the structure wherein plural siloxane bonds are interlinked, and preferably it has the structure wherein the siloxane bonds are three-dimensionally repeated. In particular, polysiloxane has preferably the polycondensed structure of the organosilane represented by the following general formula (I) [hereinafter referred to as organosilane (I)]:

$$(R^1)_nSi(OR^2)_{4-n} \quad (I)$$

wherein $R^1$ is an organic group having $C_1$–$C_8$, $R^2$ is alkyl group having $C_1$–$C_5$ or acyl group having $C_1$–$C_4$, and n is an integer of 0–2.

As the organic group having $C_1$–$C_8$, of $R^1$ in the general formula (I), the following groups are exemplified: alkyl group, such as methyl group, ethyl group, n-propyl group, i-propyl group, n-butyl group, i-butyl group, sec-butyl group, t-butyl group, n-pentyl group, n-hexyl group, n-heptyl group, n-octyl group and the like, γ-chloropropyl group, y-bromopropyl group, 3,3,3-trifluoropropyl group, γ-glycidoxypropyl group, γ-(meth)acryloxypropyl group, γ-mercaptopropyl group, γ-aminopropyl group, γ-dimethylaminopropyl group, 2-(3,4-epoxycyclohexyl) ethyl group, vinyl group, phenyl group and the like.

As alkyl group having $C_1$–$C_5$ of $R^2$, methyl group, ethyl group, n-propyl group, i-propyl group, n-butyl group, i-butyl group, sec-butyl group, t-butyl group, n-pentyl group and the like are exemplified. As acyl group having $C_1$–$C_4$ of $R^2$, acetyl group, propionyl group, butylyl group and the like are exemplified.

In the present specification, the term of "(meth)acryl" means "acryl" or "methacryl". For example, methyl(meth) acrylate means methylacrylate or methylmethacrylate.

As the organosilane (I), the following compounds are exemplified: alkoxysilanes, such as tetramethoxysilane, tetraethoxysilane, methyltrimethoxysilane, methyltriethoxysilane, ethyltrimethoxysilane, ethyltriethoxysilane, n-propyltrimethoxysilane, n-propyltriethoxysilane, i-propyltrimethoxysilane, i-propyltriethoxysilane, γ-chloropropyltrimethoxysilane, γ-chloropropyltriethoxysilane., 3,3,3-trifluoropropylmethoxysilane, 3,3,3-trifluoropropyltriethoxysilane, γ-glycidoxypropyltrimethoxysilane, γ-glycidoxypropyltriethoxysilane, γ-methacryloxypropyltrimethoxysilane, γ-methacryloxypropyltriethoxysilane, γ-mercaptopropyltrimethoxysilane, γ-mercaptopropyltriethoxysilane, 3,4-epoxycyclohexylethyltrimethoxysilane, 3,4-epoxycyclohexylethyltriethoxysilane, vinyltrimethoxysilane, vinyltriethoxysilane, phenyltrimethoxysilane, phenyltriethoxysilane, dimethyldimethoxysilane, dimethyldiethoxysilane, diethyldimethoxysilane, diethyldiethoxysilane, di-n-propyldimethoxysilane, di-n-propyldiethoxysilane, di-i-propyldimethoxysilane, di-i-propyldiethoxysilane, divinyldimethoxysilane, divinyldiethoxysilane, diphenyldimethoxysilane, diphenyldiethoxysilane and the like, acyloxysilanes, such as tetraacetoxysilane, methyltriacetoxysilane, ethyltriacetoxysilane, dimethyldiacetoxysilane, diethyldiacetoxysilane and the like. The preferred organosilanes are methyltrimethoxysilane, methyltriethoxysilane, dimethyldimethoxysilane, dimethyldiethoxysilane, tetramethoxysilane and tetraethoxysilane. The organosilane (I) may be used independently or may be used as a mixture of two or more of the organosilanes.

As the silyl group-containing vinyl resin which constitutes the surface protective layer of the photosensitive member according to the present invention, any silyl group-containing vinyl resin may be used, and the vinyl resins employed in the present invention are not restricted in particular. The publicly known vinyl resins may be used. Although the contents of silyl group are not restricted in particular, it is desirable to adjust said contents such that 1–40, preferably 2–25 of silyl groups exist per 100 of monomers which constitute the vinyl resin. When the contents of silyl group are too low, it is difficult to obtain the inventive effects according to the present invention, i.e., it is difficult to prepare the photosensitive member having excellent durability and adhesion between the surface protective layer and the photosensitive layer. When the contents of silyl group are too high, cracks occur on the surface protective layer.

A process for preparing the silyl group-containing vinyl resin employed in the present invention is not restricted in particular. For example, the vinyl resin may be prepared by producing vinyl resin firstly and then inserting silyl group into the produced vinyl resin, or may be prepared by polymerizing a vinyl compound having silyl group and any of various vinyl compounds. More particularly, the vinyl resin containing silyl group may be prepared (i) by reacting hydroxysilane with vinyl resin having C—C double bond, or (ii) by polymerizing any of various vinyl compounds and silane compound represented by the following general formula (II):

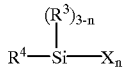

(II)

wherein $R^3$ is hydrogen atom, alkyl group having $C_1$–$C_{10}$ or aralkyl group having $C_1$–$C_{10}$, $R^4$ is organic group having polymerizable double bond, X is halogen atom, alkoxy group, acyloxy group, aminoxy group or phenoxy group, and n is an integer of 1–3.

As the hydroxysilanes used in the aforesaid preparation method (i), the following compounds are exemplified: halogenated silanes, such as methydichlorosilane, trichlorosilane, phenyldichlorosilane and the. like; alkoxysilanes, such as methyldiethoxysilane, methydimethoxysilane, phenyldimethoxysilane, trimethoxysilane, triethoxysilane and the like; acetoxysilanes, such as methyldiacetoxysilane, phenyldiacetoxysilane, triacetoxysilane and the like; aminosilanes, such as methyldiaminoxysilane, triaminoxysilane, dimethylaminoxysilane, triaminosilane and the like. These hydroxysilanes may be used independently or may be used as a mixture of two or more of these compounds.

As the vinyl resins used in the preparation method (i), any of various vinyl resins except those having hydroxy group may be employed, and they are not restricted in particular. The preferred vinyl resins are those prepared by polymerizing or copolymerizing one or more of vinyl compounds selected from the following exemplified compounds: esters of (meth)acrylic acid, such as methyl(meth)acrylate, ethyl (meth)acrylate, butyl(meth)acrylate, 2-ethylhexyl(meth) acrylate, cyclohexyl(meth)acrylate and the like; carboxylic acids, such as (meth)acrylic acid, itaconic acid, fumaric acid and the like; acid anhydrides, such as maleic anhydride and the like; epoxy compounds, such as glycidyl(meth)acrylate and the like; amino compounds, such as diethylaminoethyl (meth)acrylate, aminoethylvinylether and the like; amido compounds, such as (meth)acrylamide, diamide itaconate, α-ethylacrylamide, crotonamide, diamide fumarate, diamide maleate, N-butoxymethyl(meth)acrylamide and the like; acrylonitrile, styrene, α-methylstyrene, vinyl chloride, vinyl acetate, vinyl propinate and the like.

On the other hand, the silane compounds used in the preparation method (ii) have silyl group, especially silyl group having hydrolyzability and copolymerize with the aftermentioned various vinyl compounds. As the silane compounds which are not restricted in particular, the following compounds are exemplified: $CH_2{=}CHSi(CH_3)(OCH_3)_2$, $CH_2{=}CHSi(OCH_3)_3$, $CH_2{=}CHSi(CH_3)Cl_2$, $CH_2{=}CHSiCl_3$, $CH_2{=}CHCOO(CH_2)_2Si(CH_3)(OCH_3)_2$, $CH_2{=}CHCOO(CH_2)_2Si(OCH_3)_3$, $CH_2{=}CHCOO(CH_2)_3Si(CH_3)(OCH_3)_2$, $CH_2{=}CHCOO(CH_2)_3Si(OCH_3)_3$, $CH_2{=}CHCOO(CH_2)_2Si(CH_3)Cl_2$, $CH_2{=}CHCOO(CH_2)_2SiCl_3$, $CH_2{=}CHCOO(CH_2)_3Si(CH_3)Cl_2$, $CH_2{=}CHCOO(CH_2)_3SiCl_3$, $CH_2{=}C(CH_3)COO(CH_2)_2Si(CH_3)(OCH_3)_2$, $CH_2{=}C(CH_3)COO(CH_2)_2Si(OCH_3)_3$, $CH_2{=}C(CH_3)COO(CH_2)_3Si(CH_3)(OCH_3)_2$, $CH_2{=}C(CH_3)COO(CH_2)_3Si(OCH_3)_3$, $CH_2{=}C(CH_3)COO(CH_2)_2Si(CH_3)Cl_2$, $CH_2{=}C(CH_3)COO(CH_2)_2SiCl_3$, $CH_2{=}C(CH_3)COO(CH_2)_3Si(CH_3)Cl_2$, $CH_2{=}C(CH_3)COO(CH_2)_3SiCl_3$,

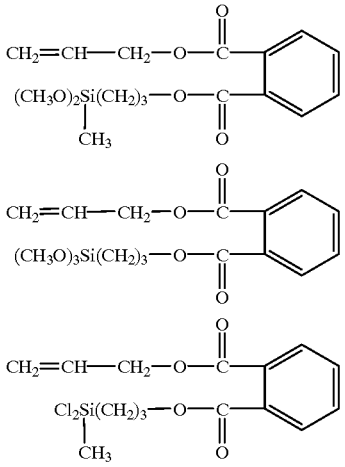

-continued

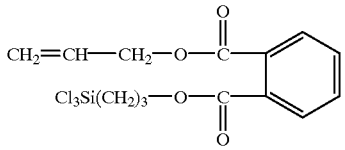

These silane compounds may be used independently or may be used as a mixture of two or more of said compounds.

As the various vinyl compounds used in the preparation method (ii), although it is possible to use the aforementioned vinyl compounds concerning the vinyl resins used in the preparation method (i), the following vinyl compounds containing hydroxyl group are exemplified: 2-hydroxyethyl (meth)acrylate, 2-hydroxypropyl(meth)acrylate, 2-hydroxyvinyl ether, N-methylolacrylamide and the like. These vinyl compounds may be used independently or may be used as a mixture of two or more of said compounds.

Although a polymerization degree-of the silyl group-containing vinyl resin used in the present invention is not restricted in particular, it is desirable to select the polymerization degree of 100–500.

As regards a blending ratio of polysiloxane and silyl group-containing vinyl resin (polysiloxane/silyl group-containing vinyl resin) in the surface protective layer of the photosensitive member according to the present invention, it is desirable to select the blending ratio by weight of 20/80–80/20, preferably 30/70–70/30. When the blending ratio of polysiloxane is low, a layer strength is lowered. On the other hand, an adhesion to the photosensitive layer becomes worse when said ratio is high. In the case where polysiloxane and silyl group-containing vinyl resin are chemically bonded in the surface protective layer, the blending ratio of polysiloxane part and silyl group-containing vinyl resin part should be fallen under the aforesaid range.

The desirable layer thickness of the surface protective layer is 0.03–5 μm, preferably 0.1–3 μm. In the case of the present invention, even if the layer thickness of the surface protective layer is relatively thick, it is possible to increase the durability and adhesion of the photosensitive member without decreasing the sensitivity and electrostatic properties, such as the residual voltage and the like, which have formerly been problematic. When the layer thickness becomes more than 5 μm, the sensitivity is lowered, and the residual voltage is increased at the time of plate wearing to bring about the occurrence of fog.

The conductive metal fine particles may be contained in the surface protective layer within the range that does not interfere with the effect of the present invention. By blending the conductive metal fine particles, it is possible to increase further the electrostatic properties of the photosensitive member according to the present invention, i.e., it is possible to maintain a good sensitivity and to lower the residual voltage. As the conductive metal fine particles, metallic antimony salt which is a conductive colloidal fine particles, an alumina sol which is a colloidal fine particle, and the like are exemplified.

The desirable size of the conductive metal fine particles is 0.01–0.3 μm, preferably 0.01–0.1 μm in mean volume particle size or maximum length of the projected image of particles. The suitable blending amount of the conductive metal fine particles is less than 50% by weight, preferably 5–30% by weight to the total weight of polysiloxane and silyl group-containing vinyl resin. When the blending amount is more than 50% by weight, an image noise will occur.

An inorganic filler, an organic fine particle and the like itSay be blended in the surface protective layer. By blending these components, it is possible to adjust readily the hardness and roughness of the surface. As the inorganic filler, metal oxides, such as silica, titanium dioxide, zinc oxide, calcium oxide, aluminum oxide, zirconium oxide and the like; metal sulfides, such as barium sulfide, calcium sulfide and the like; and metal nitrides, such as silicone nitride, aluminum nitride and the like are exemplified. Silica and titanium dioxide are preferred in particular. The inorganic fillers may be used independently or may be used as a mixture of two or more of said fillers. As the organic fine particles, fluororesin, silicone resin, acrylic resin, olefin resin and the like are exemplified. Fluororesin, such as polytetrafluoroethylene, polyvinylidene fluoride and the like; and olefin resin, such as polyethylene, polypropylene and the like are preferred in particular. The organic fine particles may be used independently or may be used as a mixture of two or more of said fine particles.

The desirable size of the inorganic filler and the organic fine particles is 0.01–1.0 μm, preferably 0.01–0.3 μm in mean volume particle size or maximum length of the projected image of particles. The desirable blending amount of the inorganic filler is less than 50% by weight, preferably 5–30% by weight to the total weight of polysiloxane and silyl group-containing vinyl resin. The desirable blending amount of the organic fine particles is 1–150% by weight, preferably 5–100% by weight to the total weight of polysiloxane and silyl group-containing vinyl resin. When the blending amount of the inorganic fillers or the organic fine particles becomes too much, the sensitivity of the photosensitive member is lowered, and the residual voltage is increased at the time of plate wearing to bring about the occurrence of fog.

In order to prepare the surface protective layer of the present invention, any preparation method may be adopted insofar as that the aforementioned surface protective layer can be formed. For example, the surface protective layer may be prepared by applying the surface protective solution comprising at least the aforesaid polysiloxane and silyl group-containing vinyl resin on the photosensitive layer and then drying the applied solution, or by applying the surface protective solution comprising the aforesaid polysiloxane or the precursor which can form said polysiloxane and silyl group-containing vinyl resin on the photosensitive layer and then curing the applied solution. However, the latter method is preferred because the durability and adhesion to the photosensitive layer are increased according to the curing process wherein polysiloxane is three-dimensioned to bond chemically the polysiloxane and silyl group-containing vinyl resin. As regards the precursor of polysiloxane, the coating method, the curing condition and the like, the following more preferred embodiments may be applied.

In the more preferred embodiment of the present invention, the surface protective layer is prepared by applying the resin solution comprising the reaction product of the polysiloxane precursor and silyl group-containing vinyl resin and desirable additives on the photosensitive layer and then curing said applied reaction product. This preparation method of the surface protective layer provides a surface protective layer comprising-the polymer wherein polysiloxane and silyl group-containing vinyl resin are chemically bonded, more particularly the vinyl resin is incorporated into the structure of polysiloxane in which the siloxane bonds are three-dimensionally repeated.

The aforesaid method will be explained in detail. First of all, the polysiloxane precursor is reacted with the aforesaid vinyl resin containing silyl group. As the polysiloxane precursor, any precursor having any structure may be employed insofar as it produce the aforementioned polysiloxane in which siloxane bonds are three-dimensionally repeated. For example, the exemplified compounds as a concrete example of the aforesaid organosilane (I) and the like are mentioned.

Any reaction ratio by weight of the polysiloxane precursor and silyl group-containing vinyl resin may be adopted insofar as that the blending ratio of the polysiloxane part and the silyl group-containing vinyl resin part in the obtained surface protective layer is fallen under the aforementioned range. For example, in the case that the organosilane (I) is used as the polysiloxane precursor, 25–400 parts by weight, preferably 45–250 parts by weight of silyl group-containing vinyl resin is used to 100 parts by weight of the organosilane (I).

In this case, it is preferable to add a metallic chelate compound. The metallic chelate compound is the chelate compound of the metal selected from the class consisting of zirconium, titanium and aluminum [hereinafter referred to as metallic chelate compound (III)]. It is believed that the metallic chelate compound (III) accelerates the hydrolysis and/or partial condensation reaction of the aforesaid polysiloxane precursor and silyl group-containing vinyl resin, and accelerates the formation of the cocondensate of the both components.

As the metallic chelate compound (III), the compounds represented by the following general formula, the partially hydrolyzed products of these compounds and the like are exemplified:

$$Zr(OR^5)_p(R^6COCHCOR^7)_{4-p}$$

$$Ti(OR^5)_q(R^6COCHCOR^7)_{4-q}$$

$$Al(OR^5)_r(R^6COCHCOR^7)_{3-r}$$

In the above formulae, $R^5$ and $R^6$ indicate indepedently monovalent hydrocarbon radical having $C_1$–$C_6$, such as ethyl group, n-propyl group, i-propyl group, n-butyl group, sec-butyl group, t-butyl group, n-pentyl group, n-hexyl group, cyclohexyl group, phenyl group and the like, $R^7$ indicates the same monovalent hydrocarbon radical having $C_1$–$C_6$ as those indicated by $R^5$ and $R^6$ as well as alkoxy group, such as methoxy group, ethoxy group, n-propoxy group, n-butoxy group, sec-butoxy group, t-butoxy group, lauryloxy group, stearyloxy group and the like, p and q is an integer of 0–3, and r is an integer of 0–2.

As the concrete examples of these metallic chelate compounds (III), the following compounds are mentioned: zirconium chelate compounds, such as tri-n-butoxy ethylacetoacetate zirconium, di-n-butoxy bis(ethylacetoacetate) zirconium, n-butoxy tris(ethylacetoacetate)zirconium, tetrakis(n-propylacetoacetate)zirconium, tetrakis (acetylacetoacetate)zirconium, tetrakis(ethylacetoacetate) zirconium and the like; titanium chelate compounds, such as di-i-propoxy bis(ethylacetoacetate)titanium, di-i-propoxy bis(acetylacetate)titanium, di-i-propoxy bis(acetylacetone) titanium and the like; aluminum chelate compounds, such as di-i-propoxy ethylacetoacetate aluminum, di-i-propoxy acetylacetonate aluminum, i-propoxy bis(ethylacetbacetate) aluminum, i-propoxy bis(acetylacetonate)aluminum, tris (ethylacetoacetate)aluminum, tris(ethylacetate)aluminum, tris(acetylacetonate)aluminum, monoacetylacetonate bis (ethylacetoacetate)aluminum and the like. Among these compounds, tri-n-butoxy ethylacetoacetate zirconium, di-i-propoxy bis(acetylacetonate)titanium, di-i-propoxy ethylacetoacetate aluminum and tris(ethylacetoacetate)aluminum are preferred. These metallic chelate compounds (III) may be used independently or may be used as a mixture of two or more of said compounds.

An adding amount of the metallic chelate compounds (III) is 0.01–50% by weight, preferably 0.5–20% by weight to the total weight of polysiloxane and silyl group-containing vinyl resin. For example, in the case that organosilane (I) is used as a polysiloxane precursor, the adding amount of the metallic chelate compounds (III) is 0.01–50 parts by weight, preferably 0.5–20 parts by weight to 100 parts by weight of the sum of organosilane (I) and silyl group-containing vinyl resin used. When the amount of the metallic chelate compounds (III) is too low, it is feared that the three-dimensionalization cannot be achieved in the post process. On the other hand, when said amount is too high, a pot life of the coating solution becomes worse.

The reaction condition depends on the reactivity of the polysiloxane precursor used, and it is not restricted in particular insofar as it is so mild that the reaction product obtained does not have the three-dimensionally repeated siloxane bond. For example, in the case that organosilane (I) is used as the polysiloxane precursor, it is preferable to carry out the reaction at 60–80° C. for 4–6 hours.

It is preferable to add an organic solvent to the reaction system. The suitable organic solvents (a) which may be used are alcohols, aromatic hydrocarbons, ethers, ketones, esters and the like. The amount of the organic solvents (a) to be used is not restricted for the polysiloxane precursor, and is adjusted depending on a purpose of the use.

In the present embodiment, the commercially available reaction product of the polysiloxane and silyl group-containing vinyl resin (e.g. GLASKA HPC7506 supplied by JSR) may be used without carrying out in practice the reaction of the polysiloxane precursor and silyl group-containing vinyl resin, i.e., the resin solution may be prepared by dispersing said reaction product in the aforesaid organic solvent (a).

The surface protective solution is prepared by adding the desired additives to the resin solution comprising the reaction product of the polysiloxane precursor and silyl group-containing vinyl resin. The surface protective solution is coated on the photosensitive layer and cured. As the additives which may be added if necessary, the aforesaid metallic chelate compounds (III), a curing accelerator, the aforesaid conductive metal fine particles, inorganic fillers, organic fine particles and the like are exemplified. As the metallic chelate compounds (III) which may be added to the resin solution, the aforementioned compounds are exemplified.

The following compounds are exemplified as the curing accelerator: alkali metal salts of naphthenic acid, octylic acid, nitrous acid, sulfurous acid, aluminic acid, carbonic acid and the like; alkaline compounds, such as sodium hydroxide, potassium hydroxide and the like; acidic compounds, such as alkyltitanic acid, phosphoric acid, p-toluenesulfonic acid, phthalic acid and the like; aminic compounds, such as ethylenediamine, hexanediamine, rdiethylenetriamine, triethylenetetramine, tetraethylenepentamine, piperidine, piperazine, methaphenylenediamine, ethanolamine, triethylamine, various modified amines which are used as a curing agent for epoxy resin, γ-aminopropyltriethoxysilane, γ-(z-aminoethyl)-aminopropyltrimethoxysilane, γ-(z-aminoethyl)-aminopropylmethyldimethoxysilane, γ-anilinopropyltrimethoxysilane and the like; organic tin compounds of carboxylic acid type, such as $(C_4H_9)_2Sn(OCOC_{11}H_{23})_2$, $(C_4H_9)_2Sn(OCOCH{=}CHCOOCH_3)_2$, $(C_4H_9)_2Sn(OCOCH{=}CHCOOC_4H_9)_2$, $(C_8H_{17})_2Sn(OCOC_{11}H_{23})_2$, $(C_8H_{17})_2Sn(OCOCH{=}CHCOOCH_3)_2$, $(C_8H_{17})_2Sn(OCOCH{=}CHCOOC_4H_9)_2$, $(C_8H_{17})_2Sn(OCOCH{=}CHCOOC_8H_{17})_2$, $Sn(OCOCC_8H_{17})_2$ and the like; organic tin compounds of mercaptide type, such as $(C_4H_9)_2Sn(SCH_2COO)_2$, $(C_4H_9)_2Sn(SCH_2COOC_8H_{17})_2$, $(C_8H_{17})_2Sn(SCH_2COO)_2$, $(C_8H_{17})_2Sn(SCH_2CH_2COO)_2$, $(C_8H_{17})_2Sn(SCH_2COOCH_2CH_2OCOCH_2S)_2$, $(C_8H_{17})_2Sn(SCH_2COOCH_2CH_2CH_2CH_2OCOCH_2S)_2$, $(C_8H_{17})_2Sn(SCH_2COOC_8H_{17})_2$, $(C_8H_{17})_2Sn(SCH_2COOC_{12}H_{25})_2$,

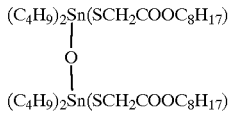

and the like; organic tin compounds of sulfide type, such as

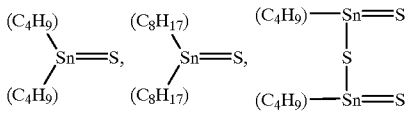

and the like; the reaction products of organic tin oxides, such, as $(C_4H_9)_2SnO$, $(C_8H_{17})_2SnO$, $(C_4H_9)_2SnO$, $(C_8H_{17})_2SnO$ and the like and esters, such as ethyl silicate, ethyl silicate 40, dimethyl maleate, diethyl maleate, dioctylphthalate and the like.

The three-dimensionalization of siloxane bonds can surely be achieved by adding further the aforementioned metallic chelate compounds (III) and the curing accelerators. The amount of the metallic chelate compounds (III) or the curing accelerators which are added to the resin solution is 0.1–80 parts by weight, preferably 0.5–60 parts by weight to 100 parts by weight of the sum of the organosilane (I) and silyl group-containing vinyl resin that are-used in the aforementioned reaction. When said amount is too low, it is feared that the layer strength is lowered. On the other hand, when said amount is too high, a pot life of the coating solution becomes worse.

Each amount of the conductive metal fine particles, inorganic fillers and organic fine particles may be adjusted as described above such that said amount to the sum of the polysiloxane and silyl group-containing vinyl resin in the surface protective layer is fallen under the aforesaid range. For example, in the case that the organosilane (I) is used as the polysiloxane precursor, the adding amount of the conductive metal fine particles is 50 parts by weight and less, preferably 5–30 parts by weight to 100 parts by weight of the sum of the organosilane (I) and silyl group-containing vinyl resin. The adding amount of the inorganic fillers is 50 parts by weight and less, preferably 5–30 parts by weight to 100 parts by weight of the sum of the organosilane (I) and silyl group-containing vinyl resin. The adding amount of the organic fine particles is 1–150 parts by weight, preferably 5–100 parts by weight to 100 parts by weight of the sum of the organosilane (I) and silyl group-containing vinyl resin.

The organic solvents (b) may be used in the present invention in order to adjust the concentration of the total solid components and the viscosity of the surface protective solution. As the organic solvents (b), it is preferable to use the organic solvents, such as alcohols, aromatic hydrocarbons, ethers, ketones, esters and the like. As the alcohols, for example, monovalent or divalent alcohols can be mentioned. Concretely, the following alcohols are exemplified: methanol, ethanol, n-propyl alcohol, isopropyl alcohol, n-butyl alcohol, sec-butyl alcohol, t-butyl alcohol, n-hexyl alcohol, n-octyl alcohol, ethylene glycol, diethylene glycol, triethylene glycol, ethylene glycol monomethyl ether, ethylene glycol monoethyl ether, ethylene glycol mono n-propyl ether, ethylene glycol mono n-butyl ether, ethylene glycol monomethyl ether acetate, ethylene glycol monoethyl ether acetate and the like. Among these alcohols, monovalent saturated aliphatic alcohols having $C_1$–$C_8$ are preferred. Benzene, toluene, xylene and the like can be exemplified as the aforesaid aromatic hydrocarbons. Tetrahydrofuran, dioxane and the like can be mentioned as the aforesaid ethers. Ethyl acetate, n-propyl acetate, n-butyl acetate, propylene carbonate and the like can be mentioned as the aforesaid esters. These organic solvents may be used independently or may be used as a mixture of two or more of said organic solvents. The method of adding the organic solvents is not restricted in particular. The organic solvents may be added at the time of preparing the surface protective solution and/or at a suitable stage after said solution is prepared.

In order to prevent a damage of the underlain photosensitive layer by the organic solvent (b) used, it is desirable to use alcoholic solvents and other solvents in a weight ratio of 80/20–100/0, preferably 90/10–100/0.

The method of coating the surface protective solution on the photosensitive layer is not restricted in particular insofar as the layer thickness of the formed surface protective layer can be controlled within the aforesaid range and the surface protective layer can uniformly be formed. The publicly known methods, such as brushing method, spray coating method, immersion method, roll coating method, flow-coating method, vacuum coating method, air-knife coating method, doctor blade coating and the like may be adopted. These coating methods can be carried out by batch mode, semicontinuous mode or continuous mode.

After the surface protective solution is coated on the photosensitive layer, the curing treatment, i.e., the three-dimensionalization of siloxane bonds, is carried out. More concretely, the photosensitive layer on which said solution is coated is left at rest at 60–125° C., preferably 80–120° C. for 10–60 minutes, preferably 20–40 minutes. When the temperature exceeds 125° C., the electrostatic properties, such as the sensitivity and the like of the photosensitive layer are deteriorated. On the other hand, when the temperature is less than 60° C., and imperfect three-dimensionalization of siloxane bonds is apt to occur, and the layer becomes fragile.

In the present invention, the photosensitive layer on which the aforementioned surface protective layer can be formed may have any of the morphologies wherein (i) a charge generating layer and a charge transporting layer are laminated on the electroconductive support in this order, (ii) the charge transporting layer and the charge generating layer are laminated on the electroconductive support in this order, and (iii) a monolayer comprising a charge transporting material and a charge generating material is laminated on the electroconductive support. The photosensitive layer having the morphology wherein the charge generating layer and the charge transporting layer are laminated on the electroconductive support in this order will be illustrated hereinafter.

A foil or plate having the shape of drum made of cupper, aluminum, iron, nickel or the like is used as the electroconductive support. The electroconductive support which can be used may be prepared by forming the metal layer on the plastics layer and the like by vacuum spraying, spattering or electroless plating of these metals, or by forming the conductive layer on the paper or plastics layer by coating, vapor deposition or spattering of conductive compounds, such as a conductive polymer, indium oxide, tin oxide and the like. In general, cylindrical aluminum supports is used. More concretely, the following cylindrical supports are exemplified: ED pipe prepared by subjecting the aluminum material to extrusion molding and then to cold drawing molding; cutting pipe prepared by subjecting the aluminum material to extrusion molding and then to drawing molding to form an aluminum pipe, which is cut into parts whose outer surfaces are subjected to the finishing cut (about 0.2–0.3 mm) by means of cutting tools, such as diamond bite; EI pipe prepared by subjecting the aluminum disc to impact work to make the cup whose outer surface-is subjected to the finishing wipe work; DI pipe prepared by subjecting the aluminum disc to deep drawing work to made the pipe whose outer surface is subjected to the finishing wipe work. These pipes may be used after they are subjected to the additional surface treatments by cutting or anodizing.

Although the charge generating layer and the charge transporting layer are laminated on these electroconductive support in this order, it is preferable to form the undercoat on the electroconductive support previously in order to prevent the charge injection from said support.

In the embodiment wherein the undercoat layer is formed on the electroconductive support, the suitable undercoat layer may be prepared by using the polymers themselves, such as polyimide, polyamide, nitrocellulose, polyvinyl butyral, polyvinyl alcohol, polyacrylate and the like, or the polymer compositions comprising any of the polymers as well as low resistant compounds, such as tin oxide, indium oxide and the like, or the deposited layers of aluminum oxide, zinc oxide, silicon oxide and the like. It is desirable to adjust the layer thickness of the undercoat to 1 $\mu$m and less.

The charge generating layer may be formed by (i) depositing the charge generating material under vacuum, (ii) coating the solution prepared by dissolving the charge generating materials in the solvents, such as amines and the like and then drying the coated solution, or (iii) coating the dispersion prepared by dispersing a pigment in a suitable solvent or the solution comprising a binder resin if necessary and then drying the coated dispersion.

As the charge generating materials which may be used for the photosensitive member according to the present invention, the following organic materials are exemplified: bisazo pigments, triarylmethane dyes, thiazine dyes, oxazine dyes, xanthene dyes, cyanine dyes, styryl dyes, pyrylium dyes, azo dyes, quinacridone dyes, indigo pigments, perylene pigments, polycyclic pigments, bisbenzimidazole pigments, indanthrone pigments, squalerium pigments, phthalocyanine pigments and the like. In addition, any other materials may be used insofar as they generate the charge carriers in extremely high efficiency when they absorb light.

The charge transporting layer is formed by coating the coating solution prepared by dispersing the charge transfering material in the solution containing the binder resin, and then drying the coated solution.

As the charge transporting material used for the photosensitive member according to the present invention, the following materials are exemplified: hydrazone compounds, phrazoline compounds, styryl compounds, triphenyl methane compounds, oxadiazole compounds, carbozole compounds, stilbene compounds, enamine compounds, oxazole compounds, triphenylamine compounds, tetraphenyl benzidine compounds, azoine compounds and the like.

The binder resins used for the preparation of the photosensitive member according to the present invention are the insulating resins. It is desirable that the insulating resins have a volume resistivity of $1\times10^{12}\Omega\cdot$cm and more which is measured independently. For example, the publicly known thermoplastic resins, thermosetting resins, photosetting resins, photoconductive resins and the like may be used as the binder resins. The following resins are mentioned as the concrete examples of the binder resins: the thermoplastic resins, such as polyester resin, polyamide resin, acryl resin, ethylene-vinyl acetate resin, ionic crosslinked olefin copolymer (ionomer), styrene-butadiene block copolymer, polycarbonate, vinyl chloride-vinyl acetate copolymer, cellulose ester, polyimide, styrol resin and the like; the thermosetting resins, such as epoxy resin, urethane resin, silicone resin, phenol resin, melamine resin, xylene resin, alkyd resin, thermosetting acryl resin, and the like; photosetting resin; photoconductive resins, such as polyvinyl carbazole, polyvinyl pyrene, polyvinyl anthracene, polyvinyl pyrrole and the like. These binder resins may be used independently or may be used as a mixture of two or more of these resins.

In the case that the charge transporting materials themselves can used as the binder, it is unnecessary to use another binder resins.

Together with the binder resins, plasticizers, such as halogenated paraffine, polybiphenye chloride, dimethyl naphthalene, dibutyl phthalate, o-terphenyl and the like, electron-attracting sensitizer, such as chloranil, tetracyanoethlene, 2,4,7-trinitrofluorenone, 5,6-dicyanobenzoquinone, tetracyanoquinodimethane, tetrachloro phthalic anhydride, 3,5-dinitrobenzoic acid and the like, and sensitizers, such as methyl violet, rhodamine B, cyanine dye, pyrilium salt, thiapyririum salt and the like may be added to the photosensitive layer of the photosensitive member according to the present invention.

Coating of the photosensitive layer can be carried out by means of publicly known various coating equipments, such as applicator, spray coater, bar coater, dip coater, roll coater, doctor blade and the like.

Although the present invention will be illustrated in detail by the following examples, the present invention is not restricted by these examples. In the following examples, "part" means "part by weight" unless otherwise indicated.

EXAMPLES

Synthesis of Silyl Group-containing Vinyl Resin (A)

Methyl methacrylate (65 parts), n-butyl acrylate (35 parts), γ-methacryloxypropyl trimethoxysilane (SZ6030: Tore Dawconing silicone company.) (20 parts) and 2-hydroxy ethyl methacrylate (6 parts) were dissolved in isopropyl alcohol (130 parts), and the solution prepared was agitated at 80° C. A solution prepared by dissolving azobisisobutyronitrile (4 parts) in tetrahydrofurane (10 parts) was dropped to the above solution, and the polymerization reaction was carried out for 4 hours to obtain the silyl group-containing vinyl resin (A) (solid content: 50%).

Synthesis of Silyl Group-containing Vinyl Resin (B)

Methyl methacrylate (65 parts), n-butyl acrylate (35 parts), γ-methacryloxypropyl trimethoxysilane (SZ6030: Tore Dawconing silicone K.K.) (20 parts), N-methylol acrylamide (10 parts) and acrylic acid (6 parts) were dissolved in isopropyl alcohol (130 parts), and the solution prepared was agitated at 80° C. A solution prepared by dissolving azobisisobutyronitrile (4 parts) in xylene (10 parts) was dropped to the above solution, and the polymerization reaction was carried out for 4 hours to obtain the silyl group-containing vinyl resin (B).

Example 1

Surface of the cylindrical aluminum alloy (JIS 5657) (outer diameter: 100 nm, length: 350 mm, thickness: 2 mm)

was subjected to a cutting work by means of a bite equipped with natural diamond as a cutting blade. The cylindrical aluminum alloy was subjected to a degreasing treatment at 60±5° C. for 5 minutes using the surfactant "Top Alclean 161" (supplied by Okuno Pharmaceutical industrial Company) as a degreasing agent, and then washed with running water. The cylindrical aluminum alloy was subjected to an etching treatment wherein said alloy was immersed in the solution of nitric acid of 100 g/l for 5 minutes, and then washed with running water. Subsequently, the cylindrical aluminum alloy was subjected to an anodizing treatment [electrolytic solution: the solution of sulfuric acid of 150 g/l, current density: 1 A/dm$^2$, the temperature of the solution: 20° C.] for 15 minutes to form the anodized layer having a thickness of 8 $\mu$m, and washed with running pure water, and then subjected to a sealing treatment at 90° C. for 30 minutes using the aqueous solution of the sealing agent comprising nickel acetate (Sealing salt AS supplied by Clariant Japan Company) of 8 g/l. The photosensitive layer was formed on the substrate having the anodized layer which was subjected to the above sealing treatment according to the following procedure.

X-type phthalocyanine (8120B supplied by Dainihon Ink Kogyo Company) (4.5 parts), butyral resin (S-Lec BH-3 supplied by Sekisui Kagaku Company) (2.5 parts) and phenoxy resin (PKHH supplied by Union Carbide Company) (2.5 parts) were dispersed in dichloroethane (500 parts) by means of sand mill. The charge generating layer was formed by applying the obtained dispersion onto the above substrate in such away that the layer thickness after dried becomes 0.3 $\mu$m.

Styryl compound represented the following formula (40 parts), polycarbonate resin (TS-2050 supplied by Teijin Kasei Company) (60 parts) and phenolic butyl hydroxytoluene (special grade reagent supplied by Tokyo Kasei Company) (2 parts) were dissolved in tetrahydrofuran (400 parts) to prepare the coating solution. The coating solution was applied onto the aforesaid charge generating layer, and then drying the applied solution to form the charge transporting layer having a thickness of 20 $\mu$m.

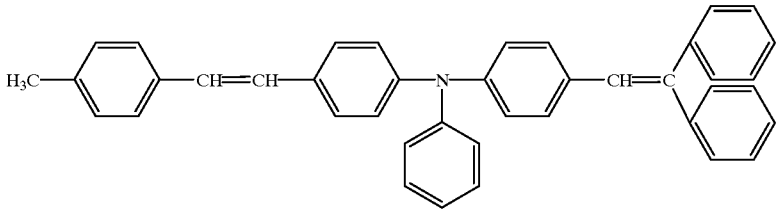

The surface protective solution was prepared by the following procedure.

Dimethyl dimethoxysilane (AY43-004 supplied by Tore Dawconing Silicone Company) (30 parts), methyl trimethoxysilane (SZ6070 supplied by Tore Dawconing Silicone Company) (100 parts), silyl group-containing vinyl resin (A) (50 parts) and aluminum tris(ethyl acetoacetate) (20 parts) were admixed with isopropyl alcohol (40 parts) and ion exchange water (30 parts), and the polymerization reaction was carried out at 60° C. for 5 hours. After cooling the reaction mixture, acetylacetone (20 parts) was added to said mixture to obtain the resinous solution. The surface protective solution was prepared by mixing the resinous solution (8 parts), dibutyltin dimaleate which is a curing accelerator (2 parts) and isopropyl alcohol (20 parts). The photosensitive member for electrophotography according to the present invention was prepared by applying the obtained surface protective solution on the aforesaid charge transporting layer in such a way that a layer thickness was 2 $\mu$m after drying, and then the applied solution was dried at 120° C. for 10 minutes to give the surface protective layer.

Example 2

The same procedure as described in Example 1 was carried out except for forming the surface protective layer as described below. Tetraethoxysilane(supplied by Tokyo Kasei Company; first grade reagent) (30 parts), methyl trimethoxysilane (SZ6070 supplied Tore Dawconing Silicone Company) (100 parts), silyl group-containing vinyl resin (A) (50 parts) and diisopropoxybis(acetylacetate) titanium (20 parts) were admixed with isopropyl alcohol (40 parts) and ion exchange water (30 parts), and the polymerization reaction was carried out at 60° C. for 5 hours. After cooling the reaction mixture, acetylacetone (20 parts) was added to said mixture to obtain the resinous solution. The surface protective solution was prepared by mixing the obtained resinous solution (8 parts), dibutyltin dimaleate (2 parts) and isopropyl alcohol (20 parts). The photosensitive member for electrophotography according to the present invention was prepared by applying the obtained surface protective solution onto the aforesaid charge transporting layer in such a way that a layer thickness became 2 $\mu$m after drying, and then drying the applied solution at 120° C. for 10 minutes to form the surface protective layer.

Example 3

The same procedure as described in Example 1 was carried out except for forming the surface protective layer as described below. Fine particles of the conductive colloidal metal antimony salt (Celnax CX-Z401M supplied by Nissan Kagaku Company) (1 part) and isopropyl alcohol (20 parts) were dispersed in the reaction product of the organosilane and silyl group-containing vinyl resin(Glasca HPC7506 supplied by JSR Company) (8 parts) for 60 minutes by. means of a sand mill. Then the curing agent which is a tin compound (HPC404 supplied by JSR Company) (2 parts) was added to the above dispersion to obtained the surface protective solution. The photosensitive member for electrophotography according to the present invention was prepared by applying the obtained surface protective solution onto the aforesaid charge transporting layer in such a way that a layer thickness became 2 $\mu$m after drying, and then drying the applied solution at 120° C. for 10 minutes to form the surface protective layer.

Example 4

The same procedure as described in Example 1 was carried out except for forming the surface protective layer as described below. The resinous solution was obtained by the same procedure as described in Example 1 except for using the silyl group-containing vinyl resin (B) in place of the silyl group-containing vinyl resin (A). Colloidal fine particle Alumina Sol 200 (supplied by Nissan Kagaku Company) (20 parts) were added to the resinous solution and dispersed in said solution for 60 hours by means of the sand mill. The surface protective solution was prepared by mixing the obtained surface protective solution (8 parts), dibutyltin dimaleate which is a curing accelerator (2 parts) and isopropyl alcohol (20 parts). The photosensitive member for electrophotography according to the present invention was prepared by applying the obtained surface protective solution on the aforesaid charge transporting layer in such a way that a layer thickness became 2 μm after drying, and then drying the applied solution at 120° C. for 10 minutes to form the surface protective layer.

Example 5

The photosensitive member for electrophotography was prepared by the same manner as described in Example 4 except for using the organic fine particles of polytetrafluoroethylene having a mean particle size of 0.3 μm (KD-500AS supplied by Kitamura Company) in place of the colloidal fine particles of Alumina Sol 200 supplied by Nissan Kagaku Company.

Comparative Example 1

The photosensitive member for electrophotography was prepared by the same manner as described in Example 1 except for omitting the silyl group-containing vinyl resin from the surface protective layer of Example 1.

Comparative Example 2

The photosensitive member for electrophotography was prepared by the same manner as described in Example 1 except for using the surface protective solution which was prepared by dispersing and dissolving Glasca HPC7003 which is a polysiloxane supplied by JSR Company (9 parts), HPC401 which is a curing agent supplied by JSR Company (0.3 part), Retan PG60 which is an acrylpolyol supplied by Kansai Paint Company (2 parts) and polyamide resin CM8000 supplied by Tore Company (0.6 part) in isopropyl alcohol (20 parts).

EVALUATION

Electrostatic Properties

The obtained photosensitive members were installed into the commercially available electrophotographic copying machine (CF900 manufactured by Minolta Company) and charged with electricity (−6 KV), and then an initial surface electric potential [VO(V)], a ratio of an exposure dose required to make the initial surface electric potential half-value (sensitivity [E1/2 ($\mu J/CM_2$)]) and a dark-damping rate of the surface electric potential after leaving in the dark for 5 seconds [DDR 5(%)] were measured.

Adhesion

An adhesion of the obtained photosensitive member was evaluated according to JIS K5400.

The adhesion of the surface protective layer to the photosensitive layer in each of the aforementioned photosensitive members was measured by examining a peeling state of the surface protective layer in each of the photosensitive members at the time when an adhesive tape, which was sticked over the checkers formed by scratching the surface of each photosensitive member with a cutter knife at a pitch of 1 mm within one centimeter square in its early stage after it was made, was instantaneously peeled from said surface. The standards for evaluating the adhesion of the surface protective layer are as follows:

10 . . . Each scratch is a fine line whose both sides are smooth, and no peeling appears at an intersecting point of the scratches and each square.

8 . . . Although a slight peeling is observed at the intersecting points of the scratches, no peeling appears at each square, and an area of defective parts does not exceed 5% of the total area of the squares.

6 . . . Peeling is observed at the both sides and the intersecting points of the scratches, and the area of the defective parts is 5–15% of the total area of the squares.

4 . . . A width of the peeling at the scratches is broad and the area of the defective parts is 15–35% of the total area of the squares.

2 . . . The width of the peeling at the scratches is broader than that of the standard "4" and the area of the defective parts is 35–65% of the total area of the squares.

0 . . . The area of the total defective parts due to the peeling is 65% and more of the total area of the squares.

Wearability

The obtained photosensitive members were installed into the commercially available electrophotographic copying machine (CF900 manufactured by Minolta Company), and a depth of wear of the surface of the photosensitive member was measured after 10000 sheets of papers were successively copied by means of said machine. The depth of wear is represented by a mean value of the measured values at twelve arbitrary points on the surface of the photosensitive member.

The results obtained are summerized in the table 1.

TABLE 1

| | VO | E 1/2 | DDR5 | Adhesion | Depth of wear (μm) |
|---|---|---|---|---|---|
| Example 1 | −805 | 0.42 | 8.2 | 10 | 0.3 |
| Example 2 | −800 | 0.43 | 9.2 | 10 | 0.4 |
| Exmaple 3 | −795 | 0.41 | 10.2 | 10 | 0.4 |
| Example 4 | −800 | 0.43 | 9.5 | 10 | 0.3 |
| Example 5 | −800 | 0.44 | 8.6 | 10 | 0.3 |
| Comparative example 1 | −800 | 0.52 | 9.8 | 0 | — (※) |
| Comparative example 2 | −805 | 0.5 | 9.4 | 10 | 0.8 |

(※) The depth of wear was not measured because of poor adhesion.

The photosensitive member according to the present invention has excellent durability and adhesion of the surface protective layer to the photosensitive layer. Furthermore, the photosensitive member according to the present invention exhibits excellent electrostatic properties, such as a sensitivity and the like without bringing about an occurrence of cracks.

What is claimed is:

1. A photosensitive member for electrophotography, comprising:

an electroconductive support, a photosensitive layer, and a surface protective layer comprising a binder resin and particles, the binder resin consisting of polysiloxane and silyl group-containing vinyl resin, the particles selected from the group consisting of conductive metal fine particles, inorganic filler and organic fine particles.

2. The photosensitive member for electrophotography of claim 1, wherein the polysiloxane and silyl group-containing vinyl resin are chemically bonded.

3. The photosensitive member for electrophotography of claim 1, wherein the polysiloxane is a polycondensate of an organosilane represented by the following general formula (I);

$$(R^1)_n Si(OR^2)_{4-n} \quad (I)$$

wherein $R^1$ is an organic group having $C_1$–$C_8$, $R^2$ is an alkyl group having $C_1$–$C_5$ or an acyl group having $C_1$–$C_4$, and n is an integer of 0–2.

4. The photosensitive member for electrophotography of claim 1, wherein the silyl group-containing vinyl resin has 1–40 of silyl groups per 100 of monomers constituting said vinyl resin.

5. The photosensitive member for electrophotography of claim 1, wherein the silyl group-containing vinyl resin is a reaction product of a silane compound and a vinyl resin.

6. The photosensitive member for electrophotography of claim 5, wherein the silane compound is at least one compound selected from the group consisting of halogenated silanes, alkoxysilanes, acetoxysilanes and aminosilanes.

7. The photosensitive member for electrophotography of claim 1, wherein the silyl group-containing vinyl resin is a polymerization product of a silane compound containing an organic group having polymerizable double bond and a vinyl compound.

8. The electrophotogrphic photosensitive member of claim 7, wherein the silane compound containing an organic group is the silane compound represented by the following general formula (II):

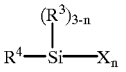

(II)

wherein $R^3$ is a hydrogen atom, an alkyl group having $C_1$–$C_{10}$ or an aralkyl group having $C_1$–$C_{10}$, $R^4$ is an organic group having polymerizable double bond, X is a halogen atom, an alkoxy group, an acyloxy group, an aminoxy group or a phenoxy group, and n is an integer of 1–3.

9. The photosensitive member for electrophotography of claim 1, wherein the silyl group-containing vinyl resin has a polymerization degree of 100–500.

10. The photosenstive member for electrophotography of claim 1, wherein a weight ratio of the polysiloxane and the silyl group-containing vinyl resin is from 20/80 to 80/20.

11. The photosensitive member for electrophotography of claim 1, wherein the surface protective layer has a thickness of 0.03–5 μm.

12. The photosensitive member for electrophotography of claim 1, wherein the conductive metal fine particles have a volume mean particle size of 0.01–0.3 μm.

13. The photosensitive member for electrophotography of claim 1, wherein the inorganic filler have a volume mean particle size of 0.01–1 μm.

14. The photosensitive member for electrophotography of claim 1, wherein the organic fine particles have a volume mean particle size of 0.01–1 μm.

15. The photosensitive member for electrophotography of claim 1, comprising an undercoat layer between the electroconductive support and the photosensitive layer.

16. The photosensitive member for electrophotography of claim 1, wherein the photosensitive layer comprises a charge generating layer and a charge transporting layer.

17. A photosensitive member for electrophotography, comprising:

an electroconductive support, a photosensitive layer, and a surface protective layer consisting of polysiloxane and silyl group-containing vinyl resin.

* * * * *